US006142833A

United States Patent [19]

Zhu et al.

[11] Patent Number: 6,142,833

[45] Date of Patent: Nov. 7, 2000

[54] ELECTRICAL CONNECTOR

[75] Inventors: Zi-Qiang Zhu; Zhang-Hua Yao, both of Kun-Shan, China

[73] Assignee: Hon Hai Precision Ind. Co., Ltd., Taipei Hsien, Taiwan

[21] Appl. No.: 09/376,153

[22] Filed: Aug. 17, 1999

[30] Foreign Application Priority Data

Apr. 20, 1999 [TW] Taiwan ..... 88206061

[51] Int. Cl.[7] ..... H01R 25/00

[52] U.S. Cl. ..... 439/638; 439/607

[58] Field of Search ..... 439/638, 607–610, 439/79

[56] References Cited

U.S. PATENT DOCUMENTS 5,637,015 6/1997 Tan et al. ..... 439/609

5,755,595 5/1998 Davis et al. ..... 439/609

5,797,770 8/1998 Davis et al. ..... 439/609

*Primary Examiner*—Gary F. Paumen

*Attorney, Agent, or Firm*—Wei Te Chung

[57] ABSTRACT

An electrical connector in accordance with the present invention comprises a dielectric housing module, a plurality of contacts received in the housing module, and a shielding module enclosing the housing module. The housing module comprises at least a first mating portion and a second mating portion. The shielding module comprises a first shell for shielding the first mating portion, and a second shell for shielding the second mating portion. The contacts are received in both the first mating portion and the second mating portion of the housing module. Thus, the first and second mating portions of the connector define first and second mating directions perpendicular to each other thereby increasing the application scope of the connector.

13 Claims, 3 Drawing Sheets

ELECTRICAL CONNECTOR

BACKGROUND OF THE INVENTION

The present invention relates to an electrical connector, and particularly to an electrical connector for electrically connecting a pair of mating connectors in perpendicular mating directions.

Pertinent conventional connectors are disclosed in Taiwan Patent Application Nos. 85208558, 85212192 and 86214395. Such conventional connectors have more than one mating port arranged in substantially parallel directions for electrically connecting with corresponding mating connectors. Moreover, the mating connectors may be of different types. Thus, the conventional connectors can fulfil a broad range of application requirements. However, if a specific application requires the positioning of one or more of the mating ports in a front panel of a computer enclosure rather than in a rear panel thereof, the conventional connector having the ports aligned in a single parallel direction can not be used to achieve such an aim. The conventional connector has no additional port for directly electrically connecting with another electrical connector assembled to the front panel within the computer enclosure after the conventional connector is fixed to the rear panel thereof.

Therefore, there is a requirement for a new electrical connector which can achieve a direct inner electrical connection within a computer enclosure.

BRIEF SUMMARY OF THE INVENTION

A main object of the present invention is to provide an electrical connector which can electrically connect two mating connectors in perpendicular mating directions thereby achieving a broad range of applications.

Another object of the present invention is to provide an electrical connector which can be simply assembled thereby decreasing costs.

An electrical connector in accordance with the present invention comprises a dielectric housing module, a plurality of contacts received in the housing module, and a shielding module enclosing the housing module. The housing module comprises at least a first mating portion and a second mating portion perpendicular to the first mating portion. The shielding module comprises a first shell for shielding the first mating portion, and a second shell for shielding the second mating portion of the housing module. The contacts are received in both the first mating portion and the second mating portion of the housing module. Thus, the first and second mating portions of the connector define first and second mating directions perpendicular to each other, thereby increasing the application scope of the connector.

A plurality of first and second contacts are received in the first mating portion, while a plurality of third contacts are received in the second mating portion. The third contacts electrically contact the corresponding first contacts thereby transmitting the same signals with the first contacts.

Other objects, advantages and novel features of the invention will become more apparent from the following detailed description when taken in conjunction with the accompanying drawings.

DETAILED DESCRIPTION OF THE INVENTION

Figure 1:
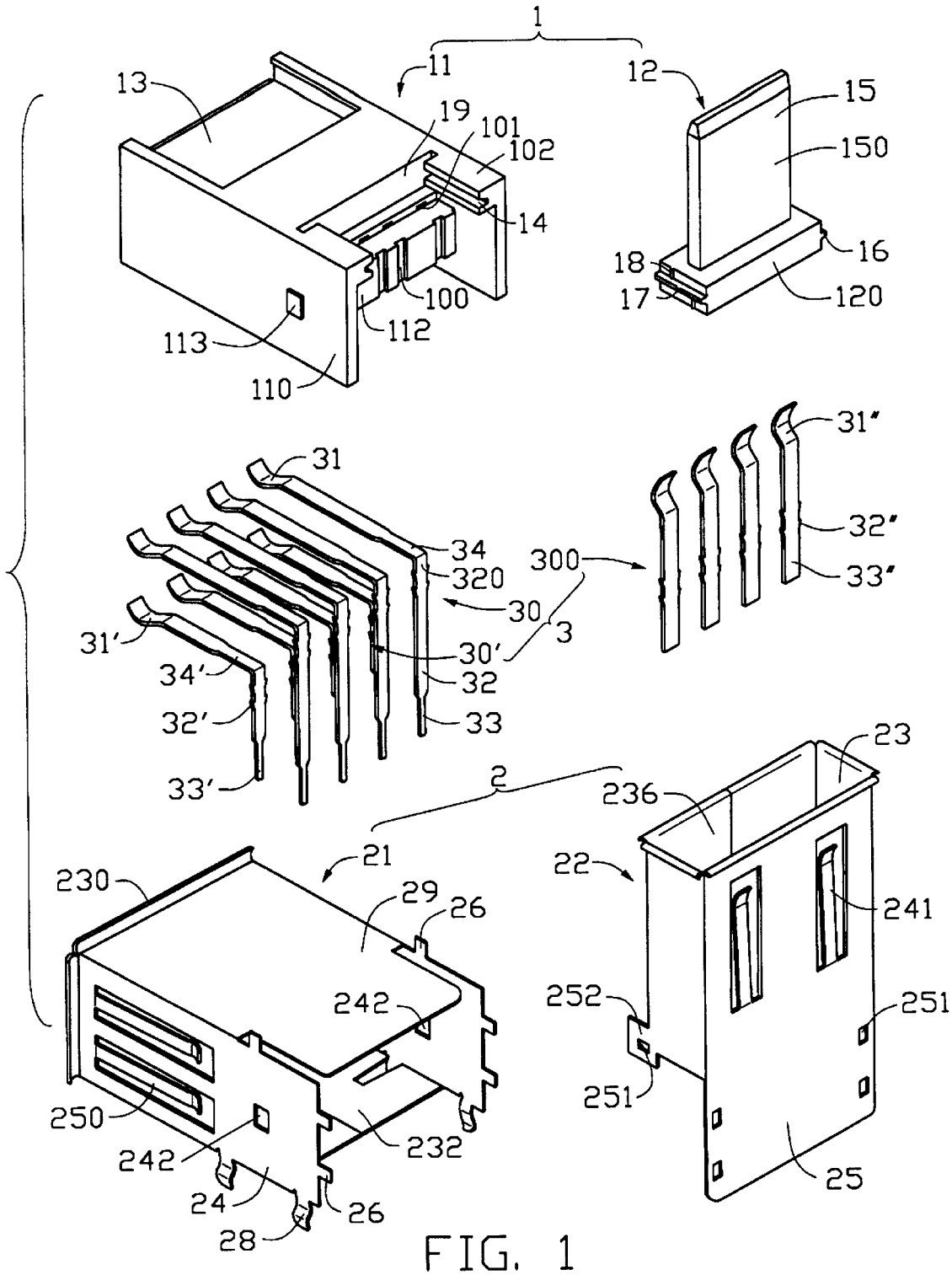
FIG. 1 is an exploded view of an electrical connector of the present invention.

Referring to FIG. 1, an electrical connector in accordance with the present invention comprises a housing module 1 including a first housing member 11 and a second housing member 12, a plurality of contacts 3 received in the first and second housing members 11, 12, and a shielding module 2 including a first shell 21 for shielding the first housing member 11 and a second shell 22 for shielding the second housing member 12. The housing module 1 comprises a first mating portion 13 formed on an end of the first housing member 11, and a second mating portion 15 formed on the second housing member 12. The first mating portion 13 comprises first and second mating boards (not labeled) in accordance with practical requirements, while the second mating portion 15 comprises a mating board 150. The first and second mating portions 13, 15 can also contain more or less mating boards for mating with the corresponding mating connectors according to practical requirements. A plurality of contact receiving passageways 101 are defined in each mating board for receiving the contacts 3 therein (the contact receiving passageways of the second mating portion is not shown).

The first housing member 11 also comprises a joining portion 110 rearwardly extending from the first mating portion 13 for connecting with the second housing member 12. A cantilevered board 112 rearwardly extends from a rear wall (not labeled) of the first mating portion 13 and defines a plurality of positioning slots 100 in a rear surface thereof. A recess 19 is defined between opposite side walls of the joining portion 1 10 and the cantilevered board 112. A pair of top platforms 102 inwardly extends from the opposite side walls of the joining portion 110 and defines a pair of receiving grooves 14 in opposite inner surfaces thereof. A pair of projections 113 is formed on outer surfaces of the side walls of the joining portion 110.

The dielectric second housing member 12 comprises the second mating portion 15 and a base 120 supporting the second mating portion 15. Contact receiving passageways (not shown) are defined in the second mating portion 15 and through the base 120. The base 120 forms a pair of flanges 16 on opposite lateral ends thereof for engaging within the corresponding receiving grooves 14 of the first housing member 11. A protrusion 17 is formed on each flange 16 for securing the base 120 within the receiving grooves 14. A pair of ribs 18 is further formed proximate each flange 16 for further securing the base 120 to the platforms 102.

The contacts 3 comprise first and second contacts 30, 30' engaging with the first mating portion 13 and third contacts 300 engaging with the second mating portion 15. Each first and second contact 30, 30' comprises a contacting section 31, 31' for electrically contacting pins of a first mating connector (not shown), an engaging section 32, 32' for engaging with the first housing member 11, a tapered connecting section 33, 33' for electrically connecting with a circuit board (not shown), and a right angled corner 34, 34' formed between the contacting section 31, 31' and the engaging section 32, 32'. Each third contact 300 comprises a contacting section 31" for electrically contacting pins of a second mating connector (not shown), an engaging section 32" for engaging with the second housing member 12, and a planar connecting section 33" for electrically contacting an upper planar surface 320 of the engaging section 32 of the corresponding first contact 30. Alternately, the planar connecting section 33" of the third contacts 300 can also be soldered to the upper planar surface 320 of the engaging section 32 of the corresponding first contacts 30.

The shielding module 2 comprises a first shell 21 for shielding the first housing member 11 and a second shell 22 for shielding the second housing member 12. The first shell 21 defines a first mating opening 230 for insertion of the first mating connector and a first receiving chamber 232 in communication with the first mating opening 230 for receiving the first housing member 11 therein. A shrouding plate 29 rearwardly extends from a top wall (not labeled) of the first shell 21. Two pairs of spring arms 250 are formed on opposite side walls 24 of the first shell 21 for electrically contacting a conductive shell of the first mating connector. A pair of latching apertures 242 is defined in the side walls 24 for engaging the projections 113 of the first housing member 11. Two pairs of lugs 28 downwardly extend from the opposite side walls 24 for connecting with the circuit board. A plurality of latching tabs 26 extend from lateral edges of the first shell 21 for latching with the second shell 22.

The second shell 22 defines a second mating opening 23 for insertion of the second mating connector and a second receiving chamber 236 in communication with the second mating opening 23 for receiving the second housing member 12 therein. A pair of spring arms 241 is formed in a rear face 25 of the second shell 22 for electrically contacting a conductive shell of the second mating connector. A pair of latching arms 252 outwardly extends from lower front portions of opposite side walls (not labeled) of the second shell 22. A plurality of latching openings 251 is defined in a lower portion of the rear face 25 and in the latching arms 252 for engaging with the corresponding latching tabs 26 of the first shell 21.

Figure 2:
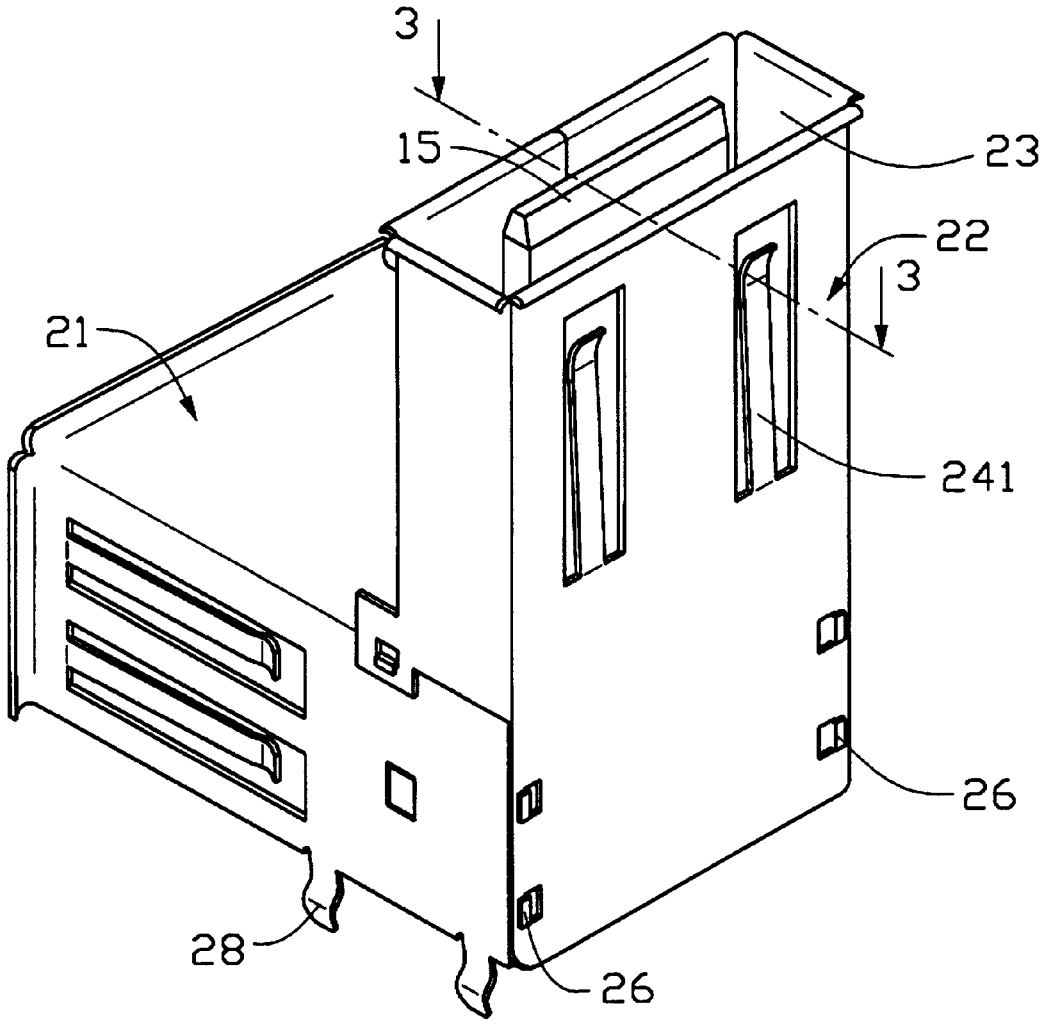
FIG. 2 is an assembled view of FIG. 1.
Figure 3:
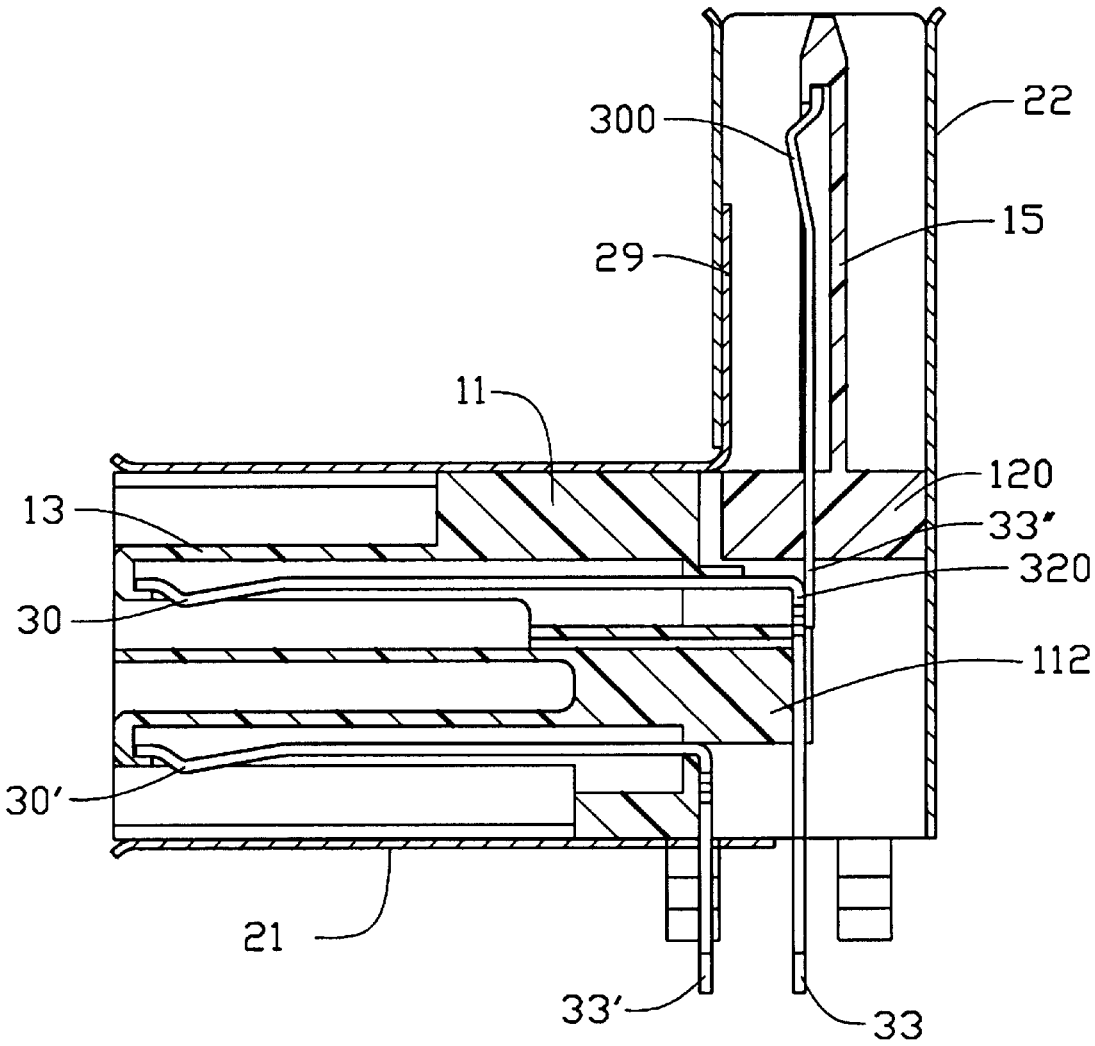
FIG. 3 is a cross-sectional view taken along line 3—3 of FIG. 2.

Referring also to FIGS. 2 and 3, in assembly, the first and second contacts 30, 30' are inserted into the corresponding first and second mating boards of the first mating portion 13. The third contacts 300 are inserted into the mating board of the second mating portion 15. The contacting sections 31, 31' of the first and second contacts 30, 30' are received in the corresponding first contact receiving passageways 101 of the first and second mating boards of first housing member 11, the corners 34 of the first contacts 30 are disposed to comply with the cantilevered board 112, and the connecting sections 33, 33' extend beyond the joining portion 110 for electrically connecting with the circuit board (not shown). The engaging sections 32 of the first contacts 30 are secured within the corresponding positioning slots 100. The contacting sections 31" of the third contacts 300 are received in the second mating portion 15 of the second housing member 12 with the engaging sections 32 being secured within the corresponding contact receiving passageways, while the connecting sections 33" downwardly extend from the base 120 for electrically contacting or being soldered with the upper planar surfaces 320 of the corresponding first contacts 30.

The second housing member 12 is then fixed to the first housing member 11. The flanges 16 of the base 120 of the second housing member 12 are secured within the corresponding receiving grooves 14 of the first housing member 11 with the ribs 18 closely abutting against the inner surfaces of the platforms 102 and the protrusions 17 abutting the inner surface of the receiving groove 14, thereby securely fixing the second housing member 12 with the first housing member 11. The connecting sections 33" of the third contacts 300 are aligned with the upper planar surfaces 320 of the first contacts 30 and are soldered therewith thereby ensuring that the first and third contacts 30, 300 transmit the same signals therethrough.

The first shell 21 is then positioned to enclose the first housing member 11 within the first receiving chamber 232. The shrouding plate 29 is upwardly bent to face the mating sections 31" of the third contacts 300 received in the second mating portion 15 of the second housing member 12.

The second shell 22 is then fixed to envelop the second housing member 12 and to receive the shrouding plate 29 of the first shell 21 therein. The corresponding latching tabs 26 are outwardly bent to engage the corresponding latching openings 251 of the latching arms 252. The other latching tabs 26 of the first shell 21 are outwardly bent to secure with the corresponding latching openings 251 of the second shell 22. Thus, assembly of the connector in accordance with the present invention is completed.

However, the first and second housing members 11, 12 can also be insert molded as one integral member. For example, the base 120 of the second housing member 12 can be integrally formed with the platforms 102 of the first housing member 11. In such a case, sufficient space should be allowed for the first and third contacts 30, 300 to be inserted into the corresponding first and second mating portions 13, 15. Alternatively, the contacts 3 can be re-designed to fulfil the requirements of insertion. The first and second housing members 11, 12 can also be re-designed to form one integral member defining horizontal and vertical mating directions for the insertion of corresponding mating connectors.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a dielectric housing module comprising a first mating portion extending in a first direction, and a second mating portion extending in a second direction perpendicular to the first direction, the first mating portion comprising first and second mating boards, the second mating portion comprising a mating board;

a plurality of first and second contacts received in corresponding first and second mating boards of the first mating portion, respectively, each of the first and the second contacts comprising a contacting section and a connecting section for electrically connecting to a circuit board, each first contact forming an engaging section between the contacting section and the connecting section for positioning the first contact within the dielectric housing module;

a plurality of third contacts received in the mating board of the second mating portion, each third contact comprising a contacting section, an engaging section securely received within the second mating portion, and a connecting section electrically connecting to a corresponding first contact; and a shielding module comprising a first shell for enclosing the first mating portion and a second shell for enclosing the second mating portion of the housing module.

2. The electrical connector as claimed in claim 1, wherein a joining portion outwardly extends from the first mating portion for connecting with the second mating portion.

3. The electrical connector as claimed in claim 2, wherein a base is formed below the second mating portion for supporting the second mating portion.

4. The electrical connector as claimed in claim 3, wherein a pair of flanges is formed on opposite lateral edges of the base for engaging with the joining portion.

5. The electrical connector as claimed in claim 4, wherein a pair of platforms inwardly extends from opposite side walls of the joining portion, each platform defining a receiving groove in an inner surface thereof for engaging with the corresponding flange of the base.

6. The electrical connector as claimed in claim 5, wherein a protrusion outwardly extends from each flange of the base for securing the flange within the corresponding receiving groove of the platform.

7. The electrical connector as claimed in claim 5, wherein a pair of ribs is further formed proximate each flange for securely engaging with the inner surfaces of the platforms.

8. The electrical connector as claimed in claim 2, wherein a cantilevered board outwardly extends from the first mating portion between the opposite side walls of the joining portion, and defines a plurality of positioning slots for engagingly positioning the engaging sections of corresponding first contacts therein.

9. The electrical connector as claimed in claim 1, wherein the first and second mating portions define a plurality of contact receiving passageways for receiving the first, second and third contacting sections of corresponding first, second and contacts therein.

10. The electrical connector as claimed in claim 1, wherein a pair of latching apertures is defined in opposite side walls of the first shell, and wherein a pair of latching blocks outwardly projects from opposite side walls of the first mating portion for engaging with the latching apertures.

11. The electrical connector as claimed in claim 1, wherein a shrouding plate rearwardly extends from a top wall of the first shell for being bent to face the third contacts received in the second mating portion.

12. The electrical connector as claimed in claim 1, wherein a plurality of latching tabs are formed on rear and lateral edges of the first shell for engaging with the second shell.

13. The electrical connector as claimed in claim 12, wherein the second shell forms a pair of latching arms extending from opposite side walls thereof and defines a plurality of first latching openings in a rear plate thereof for engaging with the corresponding latching tabs, each latching arm defining a second latching opening for engaging with corresponding latching tab.

* * * * *